US006174044B1

(12) United States Patent
Yun

(10) Patent No.: US 6,174,044 B1
(45) Date of Patent: Jan. 16, 2001

(54) HIGH SPEED PRINTING DEVICE AND METHOD THEREFOR

(75) Inventor: Young-Jung Yun, Kyungki-do (KR)

(73) Assignee: SamSung Electronics Co., Ltd., Suwon (KR)

( * ) Notice: Under 35 U.S.C. 154(b), the term of this patent shall be extended for 0 days.

(21) Appl. No.: 09/207,585

(22) Filed: Dec. 8, 1998

(30) Foreign Application Priority Data

Dec. 8, 1997 (KR) ..... 97-66682

(51) Int. Cl.[7] ..... B41J 2/145; B41J 2/15; B41J 29/38; B41J 23/00

(52) U.S. Cl. ..... 347/40; 347/5; 347/14; 347/37

(58) Field of Search ..... 347/37, 40, 43, 347/14, 20, 5

(56) References Cited

U.S. PATENT DOCUMENTS

| | | | | |
|---|---|---|---|---|
| 4,540,996 | * | 9/1985 | Saito | 347/43 |
| 5,734,393 | * | 3/1998 | Eriksen | 347/41 |
| 5,774,144 | * | 5/1999 | Eriksen | 347/41 |
| 5,905,517 | * | 5/1999 | Silverbrook | 347/61 |

* cited by examiner

*Primary Examiner*—Thinh Nguyen
(74) *Attorney, Agent, or Firm*—Robert E. Bushnell, Esq.

(57) ABSTRACT

A high speed printer comprising: an ink cartridge having nozzles with a narrower distance than a width of a printing area; a carriage capable of loading said ink cartridge; and a carriage controller controlling the reciprocation of said carriage, whereby the carriage is reciprocated as much as distance between the nozzles so that printing is carried out.

19 Claims, 6 Drawing Sheets

HIGH SPEED PRINTING DEVICE AND METHOD THEREFOR

CLAIM OF PRIORITY

Figure 1:
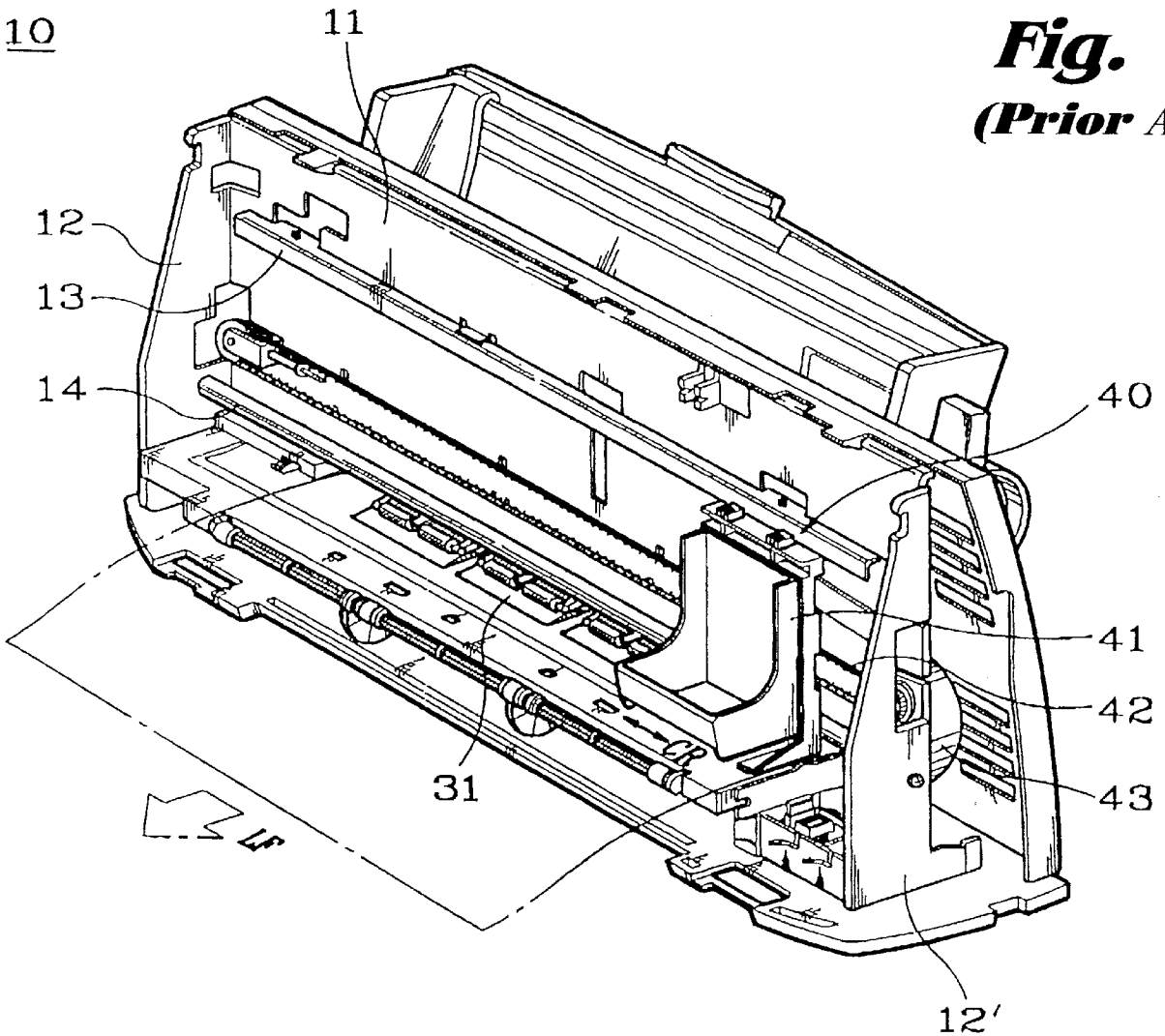
Fig. 1 (Prior Art)

This application makes reference to, incorporates the same herein, and claims all benefits accruing under 35 U.S.C. §119 from my application entitled The Increase Mechanism on Printing Speed of InkJet Printer and Increase Method Thereof filed with the Korean Industrial Property Office on Dec. 8, 1997 and there duly assigned Ser. No. 97-66682 by that Office.

BACKGROUND OF THE INVENTION

1. Field of the Invention

The present invention relates to an inkjet printer, more particularly, to an inkjet printer improving a printing speed with an ink cartridge having an increased number of nozzles and a method therefor.

2. Discussion of Related Art

Generally, an inkjet printer is a device of receiving electrical signals and outputting ink to print the data on paper, and is equipped with one or two ink heads.

In conjunction with FIG. 1, the conventional inkjet printer 10 can be described as follows. The mounting frame 11 is formed vertically, and side walls 12 and 12' are formed on the right and left of frame 11, respectively. A guide rod 14 connects side wall 12 with side wall 12' and a part 13, for preventing the separation of a carriage 41 during reciprocation, is on the upper side of frame 11. In addition, carriage 41 is installed to be able to reciprocally move along guide rod 14 and part 13, and a timing belt 42 is installed to reciprocally drive carriage 41 along guide rod 14. A feed roller 31 is installed to feed and discharge the paper in the lower part of the frame 11, and a motor 43 is installed to drive timing belt 42 in the back side of frame 11.

The feed roller 31 moves paper in incremental steps in the LF direction (the discharging, or line feeding, direction of the paper) and prints one line per step. When the resolution is 300 dpi, the number of valid pixels in one line is 2550, and 2550 pieces of binary data are printed. Here, as 1 dot is printed at a time, one line is printed when the carriage moves 2550 steps in the CR (carriage return) direction.

The time required to print one line of information is determined by the number of steps necessary for moving the carriage 41 in the CR direction and for moving the paper in the LF direction according to the print resolution, and the printing speed of the ink head. That is, in order to print fast, the print resolution has to be dropped. And in order to raise the resolution and to get a resolution of high quality, more printing time will be required.

Accordingly, it is known that the time for printing one line is as follows:

(1) the number of the carriage moving steps into the CR direction x the time required in order to move the carriage one step (2550 steps on the criterion of 300 dpi);

(2) (2550 times on the criterion of 300 dpi)×time required in order for the nozzle to jet ink; and (3) the time required in order to print one line=(1) +(2).

As shown in the above, in order to print one line, a lot of time is required however fast the printer moves because of the number of times required for repeating each operation. I have determined a method for reducing the printing time, as follows:

(1) By reducing the number of the steps required for the carriage to move in the CR direction in order to print one line; and (2) By reducing the number of times the ink head needs to jet ink by increasing the number of nozzles in the ink head.

That is, there are two methods for reducing the printing time as explained in the above. But the existing device and method cannot perform (1) and (2). Explained more in detail, the printing speed is slow in case of the conventional device and method therefor, and my method for reducing the printing time by increasing the printing speed will been described in detail below.

SUMMARY OF THE INVENTION

Accordingly, in order to overcome such drawbacks in the conventional art, it is therefore an object of the present invention to provide a high speed printing device of increasing the printing speed by shortening a driving distance of a carriage.

To achieve these and other advantages and in accordance with the purpose of the present invention, as embodied and broadly described, there is provided a high speed printer comprising: an ink cartridge having nozzles with a narrower distance than a width of a printing area; a carriage capable of loading said ink cartridge; and a carriage controller controlling the reciprocation of said carriage, whereby the carriage is reciprocated according to the distance between the nozzles and the print resolution, so that printing is carried out.

BRIEF DESCRIPTION OF THE ATTACHED DRAWINGS

Figure 2:
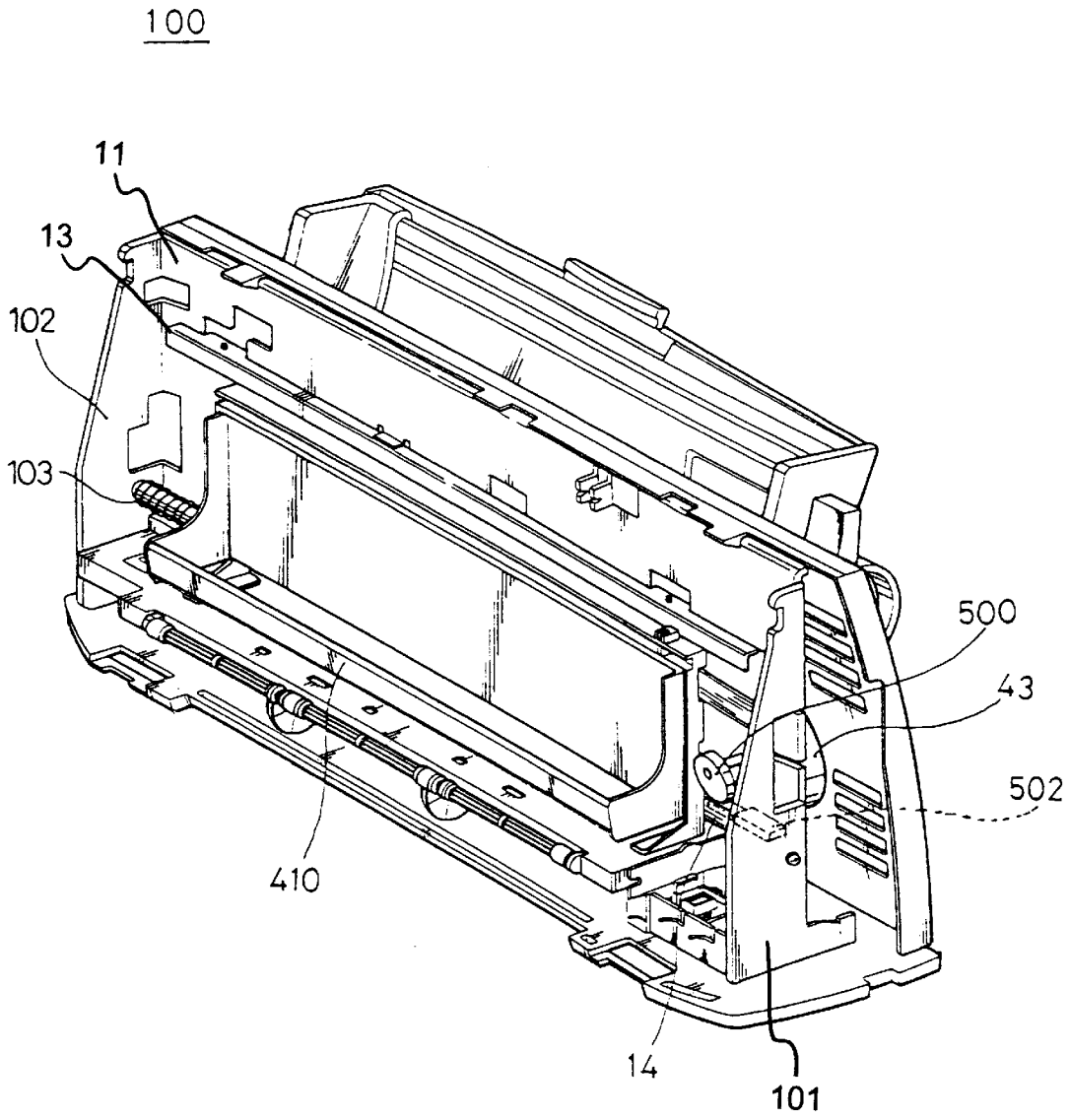
Figure 3:
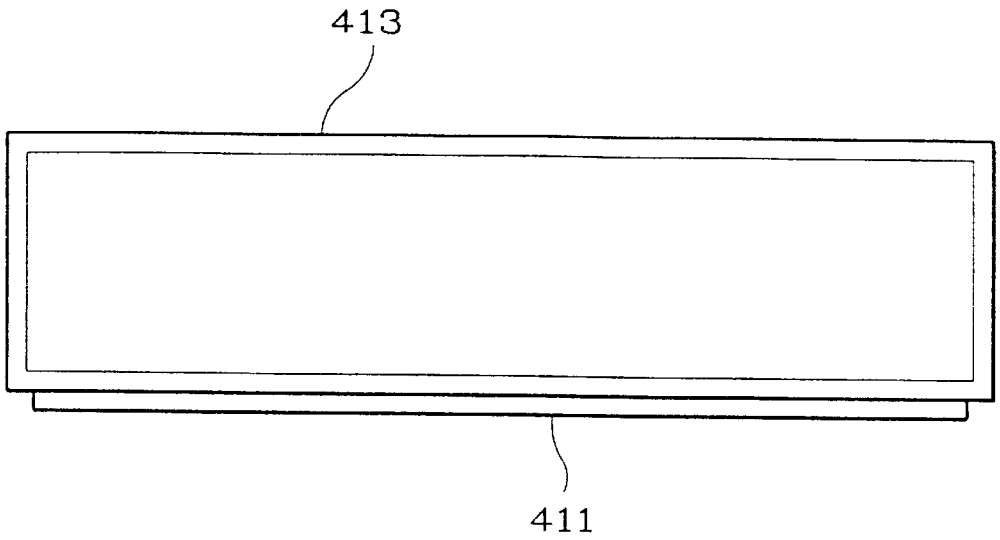
Figure 4:
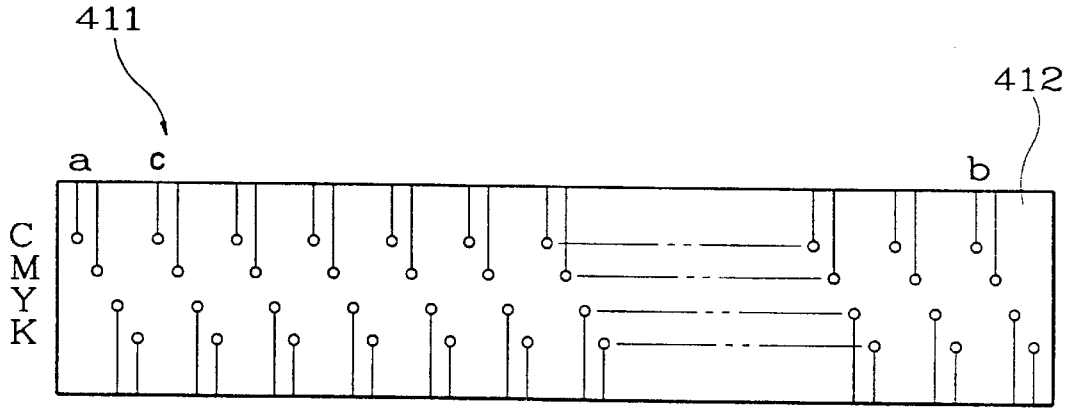
Figure 5:
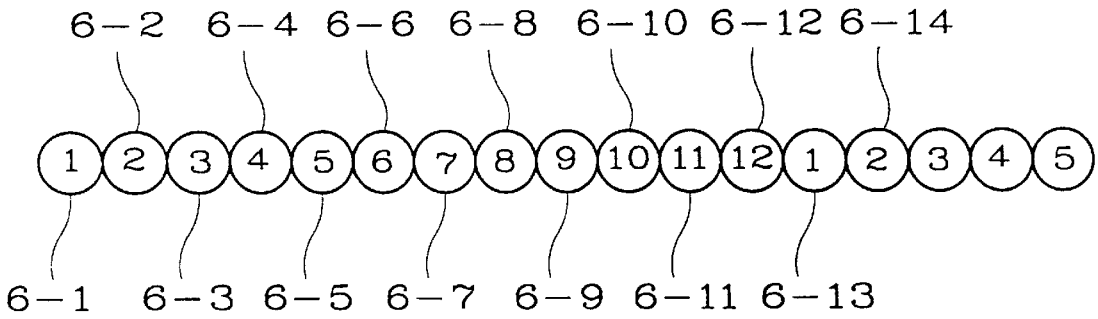
Figure 6:
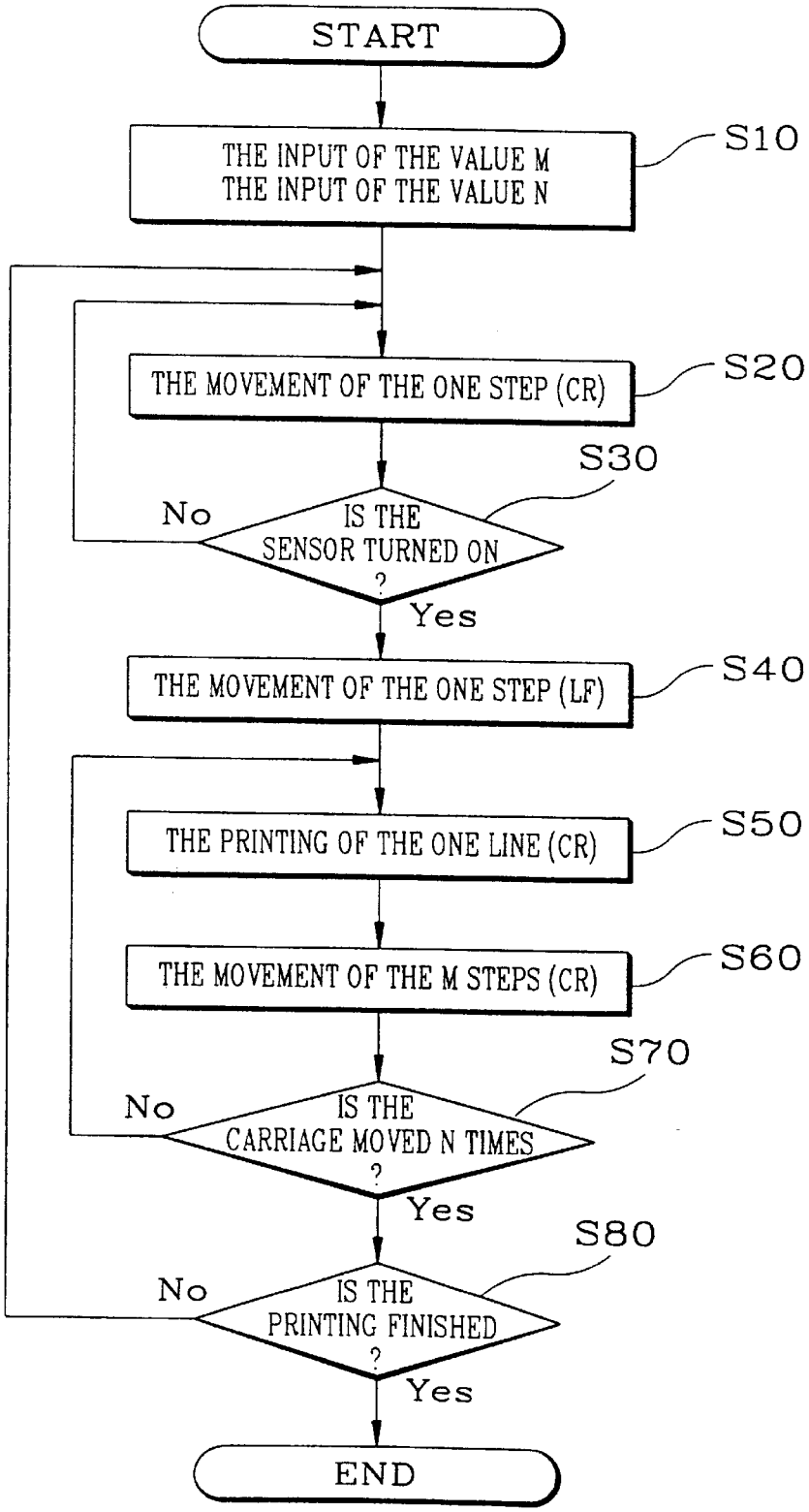
Figure 7:
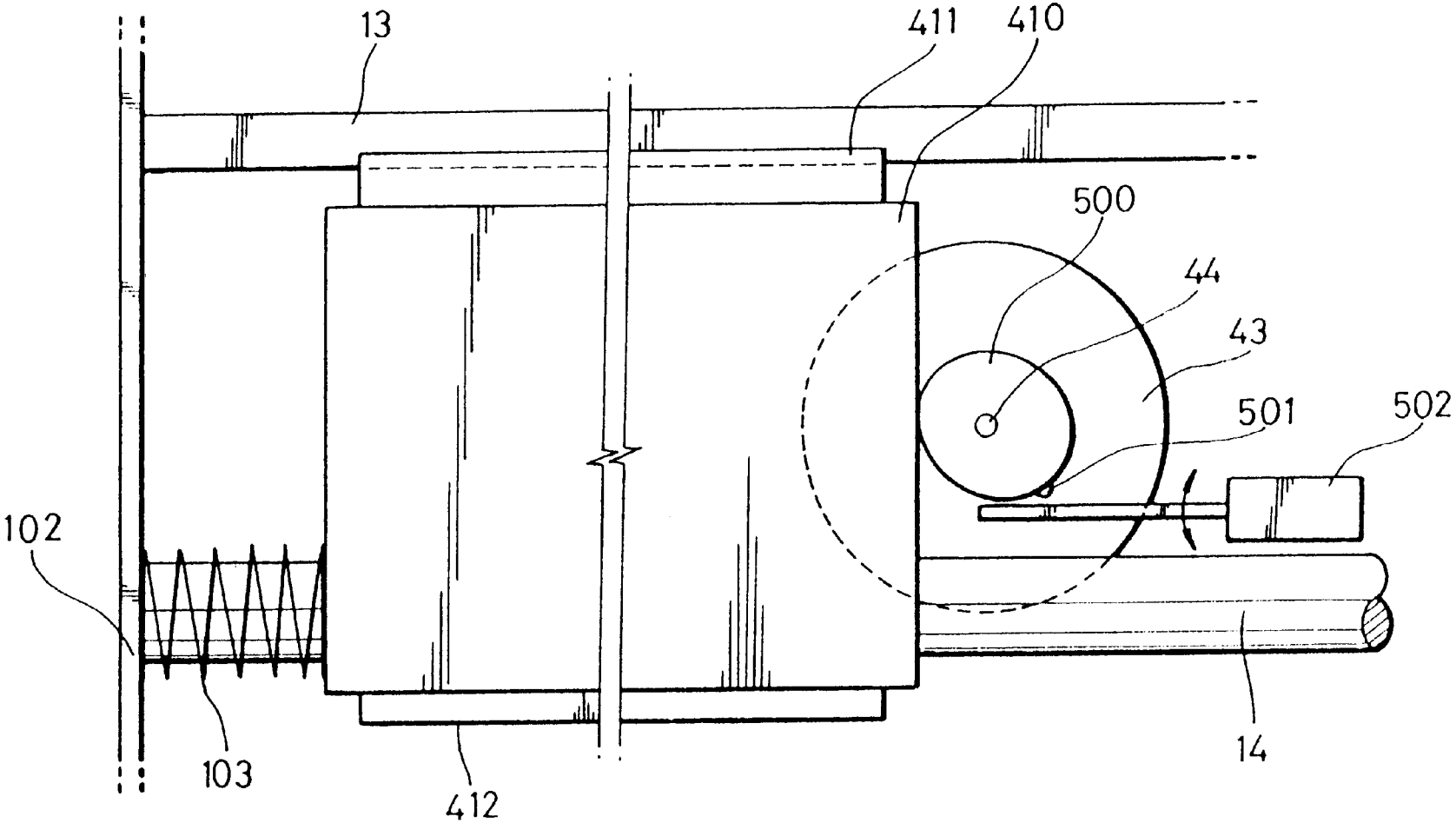

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein:

FIG. 1 is a perspective view of a conventional inkjet printer,

FIG. 2 is a perspective view of an inkjet printer according to the present invention, FIG. 3 is a front view of an ink cartridge according to the present invention, FIG. 4 is a view illustrating a nozzle shape of the ink head of the ink cartridge of FIG. 3, according to the present invention, FIG. 5 illustrates a printing method according to the present invention, FIG. 6 is a flowchart of the printing operation according to the present invention, FIG. 7 is a closeup detailed view of the components on the left and right sides of an ink cartridge/print head carriage, according to the present invention.

DETAILED DESCRIPTION OF PREFERRED EMBODIMENT

The constitution and operation of the present invention can be described in detail in conjunction with the accompanying drawings as follows.

FIG. 2 illustrates an inkjet printer 100 in accordance with the present invention. A spring 103 is installed between a left side wall 102 of frame 11 and a left side of a carriage 410 and on a guide rod 14. And to the right side of the carriage 410, a cam 500 is installed on a motor shaft 44 (FIG. 7)

installed in a motor 43. In addition, a length of carriage 410 is formed longer than a relatively narrower width of A4 paper. A sensor 502, installed bellow and separated from the cam 500, detects and checks a rotating state of cam 500. Cam 500 is in constant contact with the right side of carriage 410 to support and push the carriage 410 to the left direction thereby compressing spring 103 against left side wall 102. Carriage 410 comes to a standstill when the force applied by spring 103 to the left side of carriage 410 equals the force applied by cam 500 on the right side of carriage 410. Spring 103 biases carriage 410 to the right direction (towards motor 43). During the movement of carriage 410 in the CR direction, ink is jetted from the ink head. In the present example, the carriage is driven by the cam, but this can be also carried out by using a belt and stepping motor like in the conventional techniques. Additionally, like in the conventional techniques, a sensor can be installed between the left wall 102 and carriage 410 such that when carriage 410 is moved in the left direction, by motor 43 rotating cam 500 in one direction, into contact with this sensor the sensor would cause motor 43 to reverse the rotation direction of cam 500 and spring 103 would force carriage 410 in the right direction. The technique for reversing the direction of carriage 410, according to the present invention, will be described below with respect to FIG. 6.

FIG. 3 is a diagrammatical illustration of an ink cartridge 413 having an ink head 411 according to the present invention. Ink cartridge 413 has a length longer than half a printing line. FIG. 4 illustrates a configuration of the nozzles on nozzle part 412 of ink head 411 according to the present invention. Here, the length from "a" to "b" is about the width of A4 paper (about 21 cm), and there are 424 nozzles, including nozzles, "a" and "b" per color (C:cyan, M:magenta, Y:yellow and K:black), and the distance between nozzles is 0.508 mm.

FIG. 7 illustrates the spring 103 and the cam 500 installed in the left and right side of the carriage 410, respectively in, detail.

Referring again to FIG. 2, the mounting frame 11 is supported vertically in the one side by left side wall 102 and on the other side by right side wall 101, and the carriage separation prevention part 13 is fixed to the upper side of the frame 11 and the carriage guide rod 14 is fixed between side walls 101 and 102 adjacent to the lower side of the frame 11, and the carriage 410 slides on part 13 and rod 14 to move to the left and right side, and the nozzle part 412 is in the lower portion of the ink head 411 assembled with the carriage. And the spring 103 is installed in the side of the carriage 410 so as to push and to return the carriage, and the cam 500 is installed in the opposite side of the spring to drive restrictively the carriage.

And, as also shown in FIG. 7, the motor shaft 44 drives the cam 500 eccentrically from the center of the cam 500, and the protrusion 500 is formed on one side of the lower part of the cam 500 to check the initial position of the cam 500, and the protrusion 501 comes in contact with the sensor 502, while the cam 500 rotates. And with this, the entire operation is performed completely.

The printing method shown in FIG. 6 will be further described with respect to FIGS. 2, 4, 5 and 7. When the printing begins (START), the values M and N (described in more detail below) stored in a ROM (not shown) are input in step S10. In the present invention, the printing method depends on the decision of the printing resolution. If the resolution of the nozzle (the number of the pieces) is 50 dpi, and the printing resolution is 600 dpi, and the printing is performed by dividing the distance between the nozzles into 12 pieces, then here, the value of N is 12 and the value of M is 1/12, and N×M=1 (one rotation of the cam) is formed.

The cam 500 and the carriage 410 are driven according to the input values M and N. Here, while the carriage 410 is driven in the CR direction by movement of one step, step S20, the protrusion 501 formed on the cam is sensed by sensor 502. When it is determined, step S30, that sensor 502 is turned on, the ink head is in an initialized state, and here, nozzle "a" is located at the position 6-1 in FIG. 5, and the nozzle adjacent to nozzle "a", i.e., nozzle "c" is located at the position 6-13, and in this state, the paper is moved one step to the LF direction, step S40. At this time a first operation for jetting ink in order to start printing one line occurs at step S50. When this printing operation is finished, the carriage is move in the CR direction, step S60, as the cam is rotated one step M and the nozzles "a" and "c" are positioned at positions 6-2 and 6-14, respectively, and here, the second printing is performed. Steps S50 and S60 are repeated until it is determined at step S70 that the carriage has moved N times in the CR direction. That is, the printing is performed until nozzle "a" reaches position 6-12 by repeating steps S50 and S60. When it is determined that the carriage has moved N times in the CR direction, it is then determine in step S80 whether the printing operation is finished. If not, the carriage is returned to its initial position. In order to return the carriage to it initial position, the cam has to be rotated, step S20, until it is determined that sensor 502 is turned on again in step S30. At the same time, the paper too moves one step in the LF direction, step S40, in order to prepare for the printing of the next line, steps S50–S70. When it is determined in step S80 that the printing operation is finished, the paper is continuously fed in the LF direction and discharged from the inkjet printer.

In the meanwhile, the field of the techniques according to the present invention can also apply to other peripheral image forming devices such as a facsimile and copier, etc.

As explained in the above, the present invention can increase the printing speed of the ink head and the carriage with a low cost, and further the present invention can be easily manufactured because the distance between the nozzles is wide, and also the expense of the parts of the device, for driving and reciprocating the carriage in the left and right direction, can be reduced.

It will be apparent to those skilled in the art that various modifications can be made in the high speed printing device and method therefor of the present invention, without departing from the spirit of the invention. Thus, it is intended that the present invention cover such modifications as well as variations thereof, within the scope of the appended claims and their equivalents.

What is claimed is:

1. A high speed printer comprising:

an ink container with a length no longer than 21 centimeters;

a head, provided at a lower portion of the ink container, said head having a plurality of nozzles, said nozzles being spaced apart from each other by a predetermined distance in a direction of one printing line to enable a plurality of pixels of one line of data to be printed simultaneously;

a carriage for moving said ink container in a predetermined direction;

a stepping motor having a motor shaft; and a cam eccentrically mounted on said motor shaft and in constant contact with said carriage, said cam being rotated in accordance with incremental steps for moving said carriage in said predetermined direction from an initial position.

2. The ink cartridge as set forth in claim 1, wherein said predetermined distance is approximately 0.508 mm.

3. The ink cartridge as set forth in claim 1, wherein said plurality of nozzles is approximately 424 nozzles.

4. The ink cartridge as set forth in claim 1, wherein said head has four rows of said plurality of nozzles, each of said rows corresponding to a different ink color.

5. The ink cartridge as set forth in claim 4, wherein each row comprises 424 nozzles.

6. The ink cartridge as set forth in claim 5, wherein each of said 424 nozzles in each of said rows is separated from an adjacent nozzle in the same row by said predetermined distance, and said predetermined distance is approximately 0.508 mm.

7. The high speed printer as set forth in claim 1 further comprising:

a return spring in constant contact with said carriage for biasing said carriage in a return direction opposite to said predetermined direction, said return spring moving said carriage in said return direction after said carriage has moved in said predetermined direction by a predetermined number of said incremental steps; and a sensor which is turned on by said cam when said carriage is in said initial position.

8. The high speed printer as set forth in claim 7, wherein said cam includes a protrusion for contacting said sensor, said sensor being turned on when contacted by said protrusion.

9. A high speed printer comprising:

an ink cartridge having a plurality of nozzles in at least one row corresponding to one printing line, characterized in that a distance between a first nozzle and a last nozzle in said row is no longer than 21 centimeters;

a carriage for moving said ink cartridge in a predetermined direction; and a carriage controller for reciprocally controlling said carriage by moving said carriage in said predetermined direction in incremental steps according to a printing resolution, wherein said carriage controller comprises:

a stepping motor having a motor shaft;

a cam eccentrically mounted on said motor shaft and in constant contact with said carriage, said cam being rotated in accordance with said incremental steps for moving said carriage in said predetermined direction from an initial position;

a return spring in constant contact with said carriage for biasing said carriage in a return direction opposite to said predetermined direction, said return spring moving said carriage in said return direction after said carriage has moved in said predetermined direction by a predetermined number of said incremental steps; and a sensor which is turned on by said cam when said carriage is in said initial position.

10. The high speed printer as set forth in claim 9, wherein said ink cartridge comprises:

an ink container with a length no longer than 21 centimeters; and a head, provided at a lower portion of the ink container, said head comprising said plurality of nozzles, said nozzles being spaced apart from each other by a predetermined distance in a direction of one printing line to enable a plurality of pixels of one line of data to be printed simultaneously.

11. The high speed printer as set forth in claim 10, wherein said predetermined distance is approximately 0.508 mm.

12. The high speed printer as set forth in claim 10, wherein said plurality of nozzles is approximately 424 nozzles.

13. The high speed printer as set forth in claim 10, wherein said head comprises four rows of said plurality of nozzles and each of said rows corresponds to a different ink color.

14. The high speed printer as set forth in claim 13, wherein each row comprises 424 nozzles.

15. The high speed printer as set forth in claim 14, wherein each of said 424 nozzles in each of said rows is separated from an adjacent nozzle in the same row by said predetermined distance, and said predetermined distance is approximately 0.508 mm.

16. The high speed printer as set forth in claim 9, wherein said cam includes a protrusion for contacting said sensor, said sensor being turned on when contacted by said protrusion.

17. A high speed printing method comprising the steps of:

determining a number of steps required for moving a carriage, said carriage including a print cartridge having a print head comprising a plurality of nozzles in a least one row corresponding to a printing direction of printing one line of data on a print medium, for a predetermined distance, said predetermined distance corresponding to a distance between adjacent nozzles in said row, according to a selected printing resolution in dots-per-inch;

determining a size of said steps according to said printing resolution and said distance between adjacent nozzles in said row;

incrementally moving said carriage in said printing direction until it is determined that said carriage is in an initial position;

feeding paper in a line feeding direction to an initial paper position, said line feeding direction being orthogonal to said printing direction, when it is determined that said carriage is in said initial position;

jetting ink from said nozzles onto said paper, according to received printing data, after feeding said paper;

moving said carriage one of said steps in said printing direction by rotating a cam by a stepping motor in response to said determined size of said steps;

determining whether said carriage has been moved said determined number of steps required for moving said carriage said predetermined distance;

returning to said jetting step when it is determined that said carriage has not been moved said determined number of steps required for moving said carriage said predetermined distance;

determining whether a printing operation is finished when it has been determined that said carriage has been moved said determined number of steps required for moving said carriage said predetermined distance;

returning to said step of incrementally moving said carriage in said printing direction until it is determined that said carriage is in an initial position, when it is determined that said printing operation is not finished; and discharging said paper when it is determined that said printing operation is finished.

18. The high speed printing method as set forth in claim 17, further comprising a step of moving said carriage back to said initial position when it has been determined that said carriage has been moved said determined number of steps required for moving said carriage said predetermined distance.

19. The high speed printing method as set forth in claim 18, wherein said step of moving said carriage back to said initial position comprises biasing said carriage in a direction opposite to said printing direction in response to a biasing force generated by a return spring, said return spring being compressed by said carriage when said carriage is moved in said printing direction.

* * * * *